United States Patent [19]

Ezzell et al.

[11] 4,265,719

[45] May 5, 1981

[54] ELECTROLYSIS OF AQUEOUS SOLUTIONS OF ALKALI-METAL HALIDES EMPLOYING A FLEXIBLE POLYMERIC HYDRAULICALLY-IMPERMEABLE MEMBRANE DISPOSED AGAINST A ROUGHENED SURFACE CATHODE

[75] Inventors: Bobby R. Ezzell, Lake Jackson; Jacquelyn M. Malone, Houston; Marius W. Sorenson, Lake Jackson, all of Tex.

[73] Assignee: The Dow Chemical Company, Midland, Mich.

[21] Appl. No.: 134,244

[22] Filed: Mar. 26, 1980

[51] Int. Cl.[3] ..... C25B 1/34; C25B 9/00; C25B 11/03

[52] U.S. Cl. ..... 204/98; 204/128; 204/263; 204/266; 204/283; 204/284; 204/290 R

[58] Field of Search ..... 204/263, 266, 98, 128, 204/290 R, 283, 284

[56] References Cited

U.S. PATENT DOCUMENTS

| | | | |
|---|---|---|---|
| 3,057,794 | 10/1962 | Carlin | 204/252 |
| 3,242,059 | 3/1966 | Cottam et al. | 204/266 |
| 3,871,988 | 3/1975 | Harke et al. | 204/284 |
| 4,101,395 | 7/1978 | Motani et al. | 204/98 |
| 4,105,514 | 8/1978 | Justice et al. | 204/98 |
| 4,108,742 | 8/1978 | Seko et al. | 204/98 |
| 4,112,149 | 9/1978 | Babinsky | 427/34 |
| 4,115,237 | 9/1978 | Woodward et al. | 204/258 |
| 4,165,272 | 8/1979 | Cunningham | 204/282 |
| 4,192,725 | 3/1980 | Dotson et al. | 204/98 |

FOREIGN PATENT DOCUMENTS

| | | | |
|---|---|---|---|
| 2503652 | 8/1975 | Fed. Rep. of Germany | 204/98 |
| 2510396 | 9/1975 | Fed. Rep. of Germany | 204/98 |
| 1448904 | 9/1976 | United Kingdom | 204/98 |

*Primary Examiner*—R. L. Andrews
*Attorney, Agent, or Firm*—M. W. Barrow

[57] ABSTRACT

Cell and process for operating chlor-alkali brine electrolysis cell which contains an anode, a cathode, and a non-rigid permionic membrane. Non-rigid, non-impregnated membrane is disposed against the cathode face by a positive pressure differential maintained between the anolyte and catholyte contrary to prior art suggestions. The cathode face is shaped such that it presents a substantially non-flattened surface so that there is no more than a slight surface-to-surface contact between the membrane and the cathode. This allows the membrane to be disposed against the cathode with a much smaller voltage penalty than is taught would be expected to occur while at the same time the greater anolyte pressure prevents the explosive problem encountered by hydrogen gas entering the anolyte compartment when a leak occurs in the membrane and the catholyte pressure is greater than the anolyte pressure.

17 Claims, 14 Drawing Figures

ELECTROLYSIS OF AQUEOUS SOLUTIONS OF ALKALI-METAL HALIDES EMPLOYING A FLEXIBLE POLYMERIC HYDRAULICALLY-IMPERMEABLE MEMBRANE DISPOSED AGAINST A ROUGHENED SURFACE CATHODE

BACKGROUND OF THE INVENTION

1. Field of the Invention

The present invention relates to electrolytic cells wherein alkali metal chlorides, particularly NaCl aqueous solutions, are electrolyzed between an anode and a cathode and wherein a non-rigid, substantially hydraulically, non-impermeable, polymeric plastic film type membrane is disposed between the anode and the cathode.

2. Description of the Prior Art

The consensus of the prior art teachings regarding the location of non-rigid, hydraulically-impermeable, polymeric plastic film-type membranes with respect to adjacent, but spaced, anodes and cathodes is that the membrane should be disposed away from the cathode, being disposed either against the anode or off the surface of the anode while still disposed away from the cathode. This is particularly true for those membranes characterized as being permionic, permselective, or ion-exchange type membranes. The reasons given for so locating the membrane primarily deal with preventing large cell voltage increases taught as occurring when the membrane is located on the cathode. See for example: Seko et al., U.S. Pat. No. 4,108,742 (issued Aug. 22, 1978); Justice et al., U.S. Pat. No. 4,105,514 (issued Aug. 8, 1978); British Pat. No. 1,448,904 issued to Hooker Chemicals and Plastics Corporation (appication no. 47238/74, filed Oct. 31, 1974); and German OLS's 2,510,396, 2,503,652 and 2,455,222. This increase in voltage, i.e., the increase in cell voltage incurred when operating the cell with the membrane pressurized against the cathode by the anolyte as opposed to the cell voltage incurred when operating the cell with the membrane contacting the anode, will be referred to and defined herein as "voltage penalty".

Nearly all of the above references teach that one of the methods used to maintain the membrane away from the cathode is to maintain the pressure of the catholyte greater than that of the anolyte. Maintaining this pressure difference does urge the membrane away from the cathode and it does reduce cell operational voltage; however it can and does create a hazardous situation when electrolyzing brine for example. Leaks are known to occur in the membrane or around its edges, and when they do under the situation where the catholyte pressure is greater than the anolyte pressure, hydrogen gas generated in the catholyte chamber leaks through or around the membrane into the anolyte chamber where it can easily form an explosive gaseous mixture with the chlorine gas generated in the anolyte chamber. This situation can be avoided by operating the cell with the pressure differences reversed, i.e., with the anolyte pressure greater than the catholyte pressure. For then, if a leak occurs the gas flow is reversed and harmless reaction products are formed. That is when the anolyte pressure is greater than the catholyte pressure and a leak occurs through or around the membrane, then chlorine gas flows through or around the membrane from the anolyte chamber into the catholyte chamber wherein, instead of forming a potentially explosive gaseous mixture with the hydrogen gas, it reacts with the NaOH solution generated therein to form harmless $H_2O$, NaCl and NaOCl.

Hence, it can be seen that it would be advantageous to be able to operate such electrolysis cells with the anolyte pressure greater than the catholyte pressure without encountering the high voltage penalties taught as occurring when this is done. It is, therefore, an objective of this invention to discover a type of cathode face against which such membranes can be urged by anolyte pressure greater than the catholyte pressure which do no cause a drastic increase in cell operating voltage.

SUMMARY OF THE INVENTION

The present invention is an improved cell and an improved process for the electrolysis of an aqueous alkali metal solution and particularly for the electrolysis of brine to produce chlorine, hydrogen and caustic. The cell is comprised of an anolyte compartment, a catholyte compartment and a non-rigid, hydraulically impermeable, polymeric plastic film-type membrane separating the anolyte and catholyte compartments. The anolyte compartment contains anolyte solution and at least one substantially vertically oriented anode while the catholyte compartment contains catholyte solution and at least one substantially vertically oriented foraminous cathode with a special surface facing the membrane. There are no intervening physical constraints between the membrane and cathode. The anode and cathode face each other and are spaced from one another to form a gap therebetween. Preferably the surface of the anode facing the adjacent surface of the cathode is parallel to said cathode surface. More preferably these surfaces lie along two planar surfaces which are also parallel surfaces. Other electrode surfaces which are contemplated for use with this invention include parallel surfaces which are not planar, e.g., adjacent but spaced apart anode and cathode surfaces which are cylindrically shaped and anodes and cathodes which are wave shaped like mathematical sine waves. Pocket shaped cells are also contemplated.

The improvement for the above cell comprises: (a) a cathode surface adjacent to the membrane which has protuberances and indentations thereon and therein so as to present a substantially non-flat contact surface to the membrane; and (b) means for maintaining the anolyte at a greater pressure than the catholyte. These protuberances and indentations are on the order of size of from about 1 mm to about 2 cm.

By maintaining the anolyte pressure greater than the catholyte pressure and employing a cathode surface facing the membrane which has protuberances and indentations thereon and therein, it has been discovered that only a relatively small voltage penalty is incurred during cell operation while preventing flow of hydrogen gas from the catholyte chamber through any holes in the membrane into the anolyte compartment wherein it can form an explosive gaseous mixture with the chlorine gas generated therein.

A further improvement of this invention is the presence of a second set of protuberances and indentations superimposed on the first set discussed in the preceeding paragraph. This second set is a high-surface-area coating deposited at least on the cathode surface facing the membrane by well known means such as plasma spraying and electrodepositing combined with caustic leaching. Many compounds and metals are known to produce these high-surface-area coatings, but nickel is the preferred coating. It is further known that these coatings have indentations and protuberances in the microscopic size range, from about 1 to about 200 microns.

A better understanding of the invention may be had by reference to the drawings and the detailed discussion below.

DETAILED DESCRIPTION OF THE PREFERRED EMBODIMENT

Figure 1:
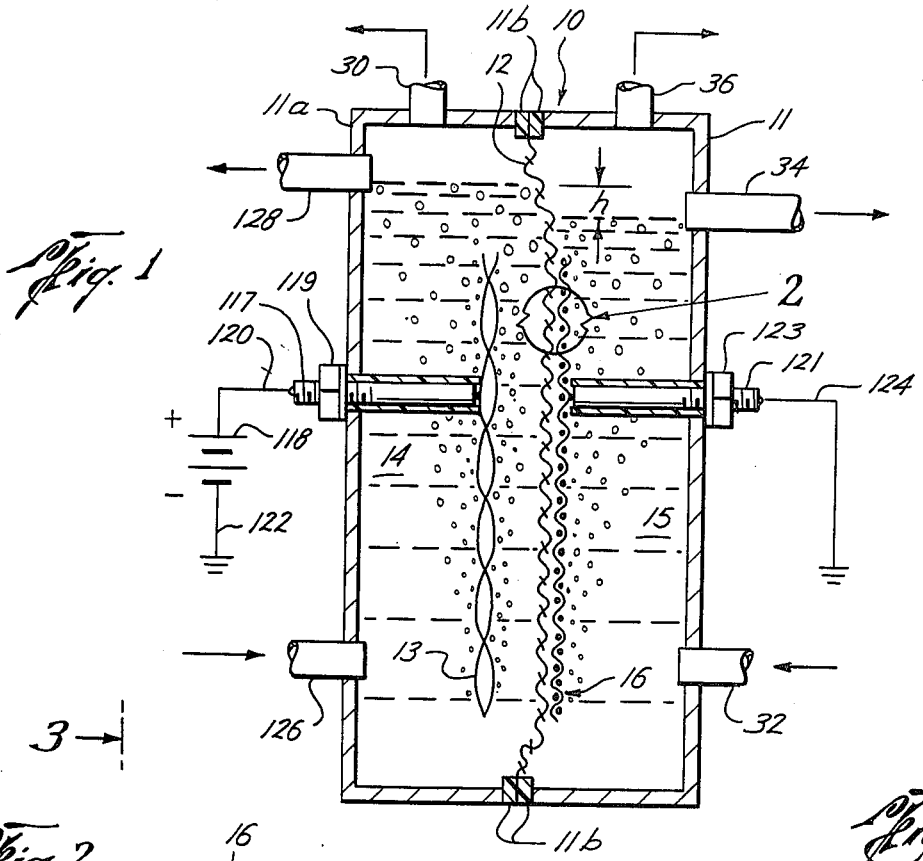
FIG. 1 is a diagrammatic side view of an electrolysis cell employing the present invention.

Referring to FIG. 1, electrolysis cell 10 can be seen to comprise cell housings 11 and **11*a*. Housings 11 and 11*a* are electrically insulated from one another by gaskets 11*b*. Cell 10 is divided into two interior compartments by membrane 12. The compartment to the left of membrane 12 contains anode 13 and anolyte 14, and, hence, is referred to as the anolyte compartment. The compartment to the right of membrane 12 contains cathode 16 and catholyte 15 and, hence, is referred to as the catholyte compartment. Anode 13 and cathode 16 are shown as vertically oriented, spaced apart, parallel, flat, foraminous metal electrodes with membrane 12 disposed between them. Of course, other configurations of anode 13 and cathode 16 are compatible with this invention. For example, the cathode 16 and/or anodes 15 may be pocket shaped such as the cathodes of Raetzch et al., U.S. Pat. No. 3,849,280 (Nov. 19, 1978) or the anodes of R. E. Loftfield et al., U.S. Pat. No. 3,591,483 (July 6, 1971). The important aspect is that the face of cathode 16 which faces membrane 12 be foraminous and have protuberances and indentations on its surface to prevent a large amount of surface-to-surface contact area to exist between membrane 12 and cathode 16 when pressure from the anolyte 14 pushes membrane 12 against the cathode 16**.

In FIG. 1, anode 13 is shown as a sheet of titanium expanded metal vertically suspended in the anolyte compartment. The anode 13 is coated with ruthenium oxide to act as a catalyst in the brine electrolysis. Anode 13 is welded to metal stud 117 for structural support and electrical connection. Stud 117 is threaded so that after anode 13 is positioned in place within the anolyte compartment, it can be locked in place by tightening nut 119 on stud 117 against the side wall of cell housing **11*a*. Similarly cathode 16 is welded to metal stud 121 for support and electrical connection. Stud 121 is locked in place by nut 123**.

A direct current electrical power source 118 is connected at its positive terminal via conductive line 120 and stud 117, to anode 13 and to ground by conductive line 122 in such a manner so that anode 13 is electrically positive with respect to cathode 16. Cathode 16 is shown connected to ground via conductive line 124 to complete an electric circuit for current to flow from anode 13 through anolyte 14, through membrane 12, and through catholyte 15 to cathode 16 so that electrolysis can occur in the cell.

It should be emphasized here that the power source 118 and lines 120, 122 and 124 are shown as they are for purposes of illustration only. There are many types of electrical power connections all of which the process of this invention applies to with equal force. In fact it should be emphasized that the whole physical cell 10 is shown merely for purposes of illustrating the invention.

It will be understood that this invention is useful in the electrolysis of many materials, but particularly is it useful in the electrolysis of aqueous solutions of alkali metal chlorides, i.e., aqueous solutions of NaCl and KCl. Aqueous solutions of NaCl are referred to as brine. For purposes of illustration, brine will be used as the substance to be electrolyzed in the following discussion of the operation of cell 10.

During electrolysis brine is pumped into the anolyte compartment through inlet port 126 wherein it becomes part of the liquid anolyte 14 present in all such brine electrolysis cells. Spent anolyte is removed from the anolyte compartment through overflow outlet port 128 while chlorine gas produced by the cell electrolysis is allowed to flow upward out of the anolyte compartment through vent 30.

On the cathode side of cell 10 during electrolysis, make-up water is pumped into the catholyte compartment through water inlet port 32. Electrolysis products, caustic and hydrogen gas, are allowed to flow out of cell 10 through caustic outlet port 34 and hydrogen gas vent 36, respectively.

Means are provided for maintaining a higher pressure in the anolyte than in the catholyte at any given height along the vertical membrane 12. In a pressurized cell this means can be any type of pumping device. In cell 10 of FIG. 1 the means used is simply a head pressure in the anolyte. This head pressure is indicated by reference character "h" in FIG. 1 wherein indicates the height by which the anolyte level in cell 10 is greater than the catholyte level. It should be noted that the anolyte density is by no means necessarily equal to the density of the catholyte. Hence, the actual height "h" of the anolyte above the catholyte will likely be unequal to the standard measurement of head pressure in inches of water. Nevertheless by adjusting "h", the pressure of the anolyte can be adjusted so that it is greater than the pressure of the catholyte. By so doing the potential explosive situation of having hydrogen gas pass through holes in membrane 12 into the anolyte chamber and mixing with chlorine gas therein is avoided. The amount of this pressure differential is not critical, but it should be sufficient to ensure that bulk flow in the event of a hole or other leak site is from anolyte compartment to catholyte compartment. A pressure difference of at least about 1 inch of water is preferred as well as one which is no more than about 50 inches of water. Too great a pressure difference can cause physical penetration of the membrane material by the protrustions on the cathode structure. A preferred range for the greater positive pressure differential of the anolyte over the catholyte is from about 2 inches of water to about 10 inches of water.

It may well be imagined that employing such a pressure differential between anolyte 14 and catholyte 15 would force the non-rigid membrane into intimate contact with the adjacent, parallel overall surface of cathode 16. It must be remembered, however, that during hydrolysis hydrogen gas bubbles are constantly being formed on this surface, that these bubbles are constantly rising between membrane 12 and cathode 16, that the rising gas bubbles on both sides of cathode 16 create quite a erratic flowpath of the liquid catholyte 15 in the catholyte chamber, and that the dynamics of this gas and liquid flow make it quite improbable that the somewhat floppy membrane 12 maintains a constant intimate contact with the cathode 16.

Whether such intimate contact is maintained or not, however, it has now been discovered that the voltage penalty paid for operating the cell 10 with the catholyte pressure greater than the anolyte pressure varies greatly with the "theoretically available contact area" between the membrane 12 and overall surface of cathode 16. The "theoretical available contact surface area" between a membrane and a cathode surface is defined herein as that flat area of the cathode's surface facing the membrane which would contact the membrane if it were pressed against the cathode surface by a uniform pressure of up to about 2 inches of water or greater. Such a pressure can be the positive pressure differential described above as existing between the anolyte 14 and catholyte 15 of cell 10 with the understanding that no electrolysis nor fluid flow is transpiring so that anolyte 14 and catholyte 15 are quiescent.

The upper limit of theoretically available contact area contemplated is about 20%. Preferably cathode surfaces are used with less than about 10% of such theoretically available contact area. As this contact area decreases, so does the voltage penalty.

The size and shape of this first described set of protuberances and indentations are varied depending somewhat on the rigidity of the descriptively non-rigid membranes. Ideally these protuberances and indentations would present only a line or points for the membrane to contact with the membrane ideally being a surface which is parallel to the overall surface of the cathode. In this ideal situation there would be zero area of surface-to-surface contact between the cathode surface and the membrane even with the ideal membrane in full contact with the overall cathode surface since true lines and points have no area. In the real world, however, there are no ideal lines, points and surfaces. All lines have some width as well as length and all points have some length and width, so both have some area against which the membrane can contact. Moreover, no surface is ideal. Thus when speaking of a non-rigid membrane whose surface is "parallel" to the overall surface of the cathode, the surfaces are not exactly parallel nor is the membrane perfectly non-rigid. The membrane when urged against the over-all cathode surface will tend not only to make real area surface-to-surface contact with the non-ideal lines and points of the cathode surface, but also this area of surface-to-surface contact will tend to increase because the non-rigid membrane will tend to partially take the shape of the protuberances sticking into it. This non-flexible or non-rigid membrane is not prefectly non-rigid, however, for as the protuberances against which it is urged by the anolyte become smaller in radius of curvature and the adjacent indentations become deeper, it becomes more difficult for the membrane to take on the shape of the protuberances and, hence, the area of surface-to-surface contact between the membrane and overall cathode surface becomes smaller.

It is within the scope of this invention for the membrane to contact the surface of the cathode or not to contact it under the influence of the higher anolyte pressure urging it in that direction. When the cell is in operation it is not certain whether the membrane maintains contact with the adjacent cathode surface or not due to the bubbles rising therebetween. The hydrogen gas generated at the cathode surface sets up such a turbulent rising two phase (gas-liquid) opaque flow due to the rising electrolytically hydrogen gas bubbles mixing with the liquid anolyte that good visual observation is very difficult even in especially constructed laboratory size test cells having transparent walls. Whether the membrane maintains a constant contact with the cathode surface is not important, however, when operating the cell with the anolyte pressure greater than that of the catholyte. What is important is that much lower voltage penalties are encountered when the surface of the cathode has protuberances and indentations on it than the high voltage penalty encounted when the metal surface of the cathode presents a substantially flat surface to the membrane for contact and the cell is operated with the anolyte pressure greater than the catholyte pressure.

A further improvement of this invention is the surprisingly smaller voltage penalty incurred when using cathode surfaces which have a high-surface-area coating, preferably of nickel, on the surfaces of the protuberances and indentations of at least the cathode surface facing the membrane. This voltage penalty might at first thought be attributal to the known fact that high-surface-area coated ferrous surfaces produce lower operational voltages than do the same surfaces without the coating. These type cathodes have become well enough known in the art to have become commonly referred to as low overvoltage cathodes, or LOC cathodes. It should be pointed out, however, that the phenomena being discussed already accounts for the known LOC cathode lower voltage effect in the subtraction of the voltages made to determine the voltage penalty. That is, it would appear that the voltage penalty for a given ferrous cathode surface having protuberances and indentations thereon and therein, such as steel woven wire, would be the same for that surface when it was coated as when it was not, for the LOC coating effect would appear to subtract out when making the voltage penalty calculation. But in fact it does not. Reather the coating further reduces the voltage penalty. There are several known general techniques for applying these high-surface-area coatings. These include (1) plasma or flam spraying and (2) electrodepositing and leaching. Besides nickel there are many other substances known to be used for making such high-surface-area low hydrogen overvoltage cathodes. Representative of these are cobalt, metal borides, iron, manganese dioxide and the like. Nickel is especially preferred from the standpoint of cost and application.

The nature of these high-surface-area coated surfaces is that of a roughened surface having protuberances thereon and indentations therein. However, this second set of protuberances and indentations are several orders of magnitute smaller than the first set of protuberances and indentations described above. The first set of protuberances and indentations are measured in the magnitude order of from about one millimeter to about one centimeter whereas the second set of protuberances and indentations (the set made by the high-surface-area coating) is measured in the micron magnitude order of from about one micron to about two-hundred microns. The visual effect is comparable to having pebbles and holes strewn over the surface of the mountains, ridges, mesas, and valleys of a mountain range. It should be remembered, of course, that the size of the first set of indentations and protuberances in the cathode surface is small itself when considering the size of the overall cathode surface which in commercial cells are in the order of magnitude of about one to two meters tall and about one-fourth to about one, two or even ten meters wide. These measurements of the orders of magnitute of protuberances and indentations are measurements of: (1) peak of the protuberance to the valley of the indentation, and (2) peak to peak of adjacent protuberances.

The membranes contemplated for use with this invention are those made of a polymeric plastic film, which are non-rigid, and which are referred to as hydraulically impermeable. The non-rigid specification may be better understood by comparing these membranes to a cotton bed sheet or a cotton string. The sheet or string offer very little resistance to a transverse pressure or force exerted on them in comparison to the resistance they exhibit toward a tension force. That is, these membranes, like a sheet or string, while having well defined lengths, widths, and thicknesses can be characterized as being floppy. This is the sense in which they are defined as being non-rigid.

The membrane employed is one which is referred to as "hydraulically-impermeable" though it is generally recognized in the art that membranes having slight permeability to water may be used in some instances; for instance, the sodium ion that is transported is hydrated. Such membranes are usually thin and may sometimes be prepared by sintering, or melting together, of particulate materials. Sometimes the membranes have small pin-holes or minute passageways or imperfections through which some water can traverse. The membranes may be of, or contain, materials which impart cation exchange capabilities or may even be of a non-ion-exchange material. Microporous sheets, where the principle means of transport is electroosomotic, may be employed. In particular, membranes prepared from fluoropolymers, such as polymers or copolymers of vinylidene fluoride, chlorotrifluoroethylene, tetrafluoroethylene, hexafluropropylene, perfluoro (alkyl vinyl ether), and the like are considered to be within the purview of the present invention.

Suitable membranes used in the process of the present invention are those composed of an inert, flexible material having cation exchange properties and which are impervious to the hydrodynamic flow of the electrolyte and the passage of anode-generated gases and anions. Examples are perfluorosulfonic acid resin membranes, perfluorocarboxylic acid resin membranes, composite membranes or chemically modified perfluorosulfonic acid or perfluorocarboxylic acid resins. Chemically modifed resins include those substituted by groups including sulfonic acid, carboxylic acid, phosphoric acid, amides or sulfonamides. Composite membranes include those employing more than one layer of either the perfluorosulfonic or perfluorocarboxylic acid where there is a difference of equivalent weight or ion exchange capacity between at least two of the layers, or where the membrane is constructed of both the perfluorosulfonic acid and the perfluorocarboxylic acid resins.

One preferred membrane material is a perfluorosulfonic acid resin membrane composed of a copolymer of a polyfluoroolefin with a sulfonated perfluorovinyl ether. The equivalent weight of the perfluorosulfonic acid resin is from about 900 to about 1600, and preferably from about 1100 to about 1500. The perfluorosulfonic acid resin may be supported by a polyfluoroolefin fabric. Perfluorosulfonic acid resin membranes sold commercially by E. I. DuPont de Nemours and Company under the trademark "Nafion" are suitable examples of the preferred membrane.

Another preferred embodiment is a perfluorocarboxylic acid resin membrane having an ion exchange capacity of up to 1.3 milliequivalents per gram, as produced by Asahi Glass Company.

As used herein, the term "membrane" is employed to mean a thin sheet of material which is impermeable, or substantially impermeable, to the hydraulic flow of water, and which will allow passage of hydrated $Na^+$ from the anolyte to the catholyte while substantially preventing the passage of $Cl^-$ from anolyte to catholyte. To practitioners of the relevant arts the term "diaphragm", in contradistinction to "membrane", usually refers to materials which permit the hydraulic passage of anolyte to the catholyte portion, such as asbestos diaphragms.

Figure 7:
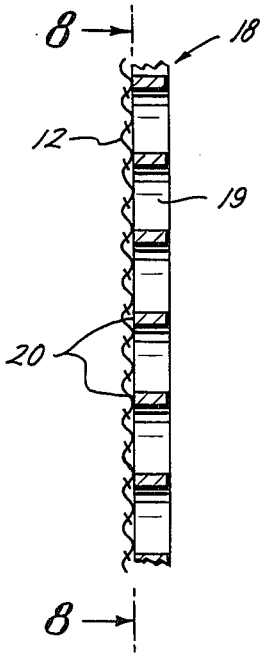
FIG. 7 is an alternative view of FIG. 2 in that cathode 16 is made of punched plate instead of unflattened woven wire for purposes of comparison in the examples below; it is not a part of the present invention.
Figure 8:
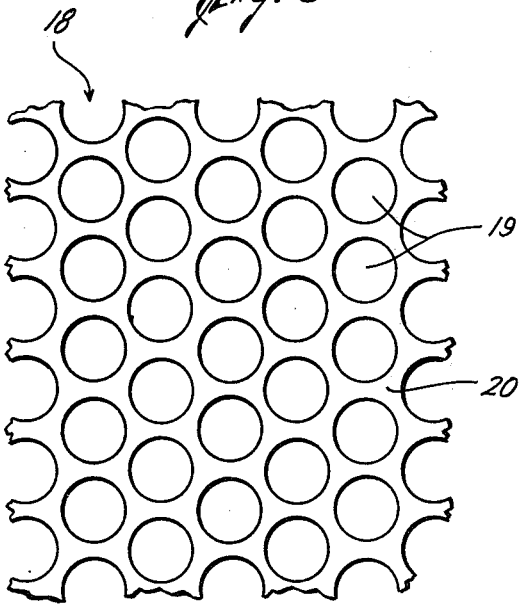
FIG. 8 is a front view of the punched plate of FIG. 7 taken along line 8—8 in FIG. 7.

A fuller appreciation of the types of cathode surface envisioned for this invention can be had by reference to FIGS. 2–6 and FIGS. 9–12 wherein four suitable types of cathode surfaces are shown. The standard punched steel plate of FIGS. 7–8 is shown as an example of a cathode surface which is unsuitable for this invention because it has too much flat surface area (too much "theoretically available contact area") available for contact by membrane 12. All of these cathode materials, and more, will be included in the runs of various cathode materials given below. Some of the cathode configurations shown in FIGS. 2–12 were tested with and without a high-surface-area nickel coating plasma sprayed on them. Since the protuberances and indentations due to the presence of a high-surface-area nickel coating are too small to be seen on any of the surfaces shown in FIGS. 2–12, the same drawing, therefore, will be used in some substances in the runs below to represent a cathode with and without a high-surface-area nickel coating.

Figure 2:
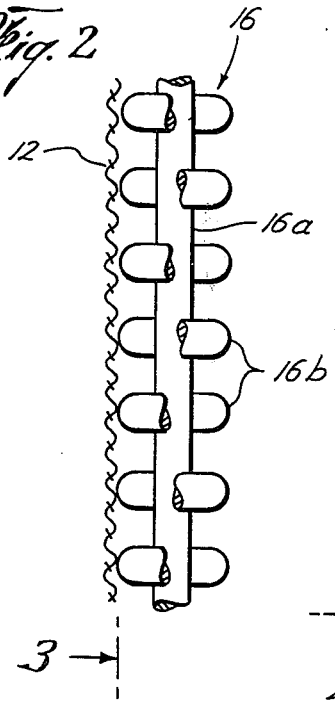
FIG. 2 is an enlarged view of that portion of the cell of FIG. 1 shown encircled in FIG. 1 by circle 2 therein, with membrane fabric 12 shown contacting cathode 16, said cathode 16 in this figure being shown as unflattened woven wire.
Figure 3:
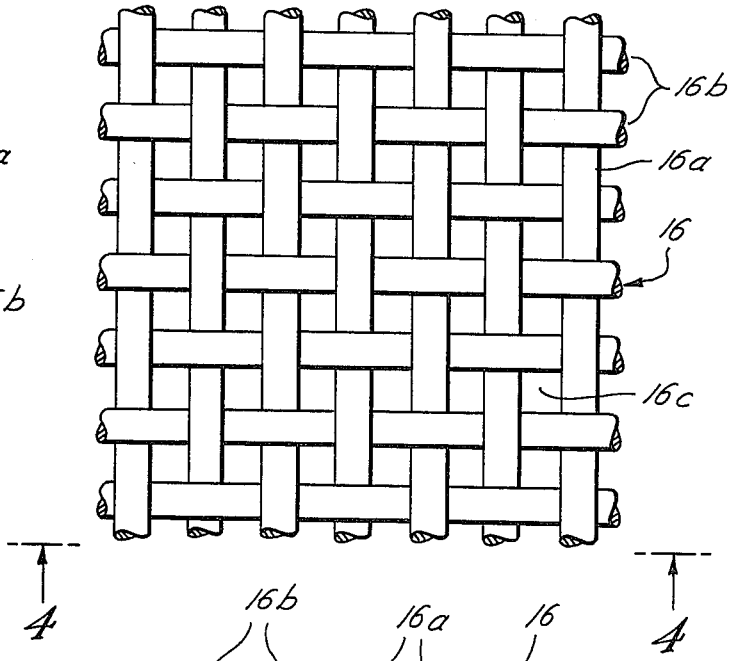
FIG. 3 is a front view, taken along line 3—3 in FIG. 2, of the unflattened woven wire shown as cathode 16 in FIG. 2.
Figure 4:
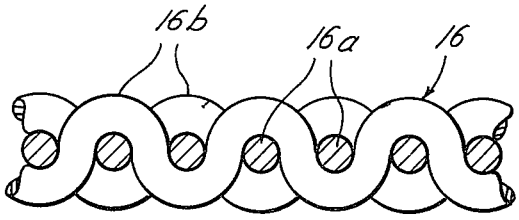
FIG. 4 is a bottom view of the woven wire of FIG. 3 taken along line 4—4 in FIG. 3.

Woven wire is shown as cathode 16 in FIGS. 2–4 with membrane 12 shown contacting the outer edge of the horizontally running wire strands 16*b* adjacent to the membrane 12. These horizontal strands 16*b* against which membrane 12 is shown contacting are a first set of protuberances for the woven wire which the vertical strands 16*a* form a first set of indentations between adjacent horizontal strands 16*b* as can be seen in FIG. 2. Openings 16*c* (see FIG. 3) through the woven wire form the holes which make the woven wire cathode foraminous. It can be seen even from this small section of the woven wire cathode 16 shown in FIGS. 2–4 that a section of it large enough to be the cathode 16 in cell 10 in FIG. 1 would have an oveall surface which would ordinarily be described as a flat planar cathode surface. Yet on a strand to strand (section to section) basis, the same cathode surface would be described a rough or non-flat surface full of protuberances and indentations. This difference between descriptions based on the scale of scrutiny given the cathode is why the cathodes of this invention can be described as having an overall surface which is parallel to a smooth surfaced membrane while at the same time describing the same cathode surface as having protuberances and indentations which provide virturally no available surface-to-surface contact area between the membrane and cathode.

Not able to be shown in FIGS. 2–4, because of their comparatively much smaller size, is a second set of protuberances and indentations which are present as a high-surface-area nickel coating. This double set of indentures and protuberances on the overall cathode surface facing the membrane is one of the more preferred embodiments of a cathode useful in this invention.

Figure 5:
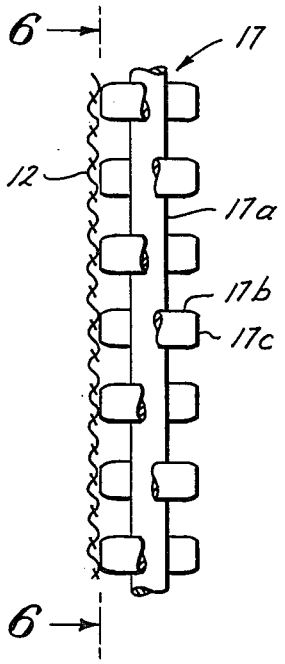
FIG. 5 is an alternative view of FIG. 2 in that cathode 16 is shown made out of flattened woven wire instead of unflattened woven wire.
Figure 6:
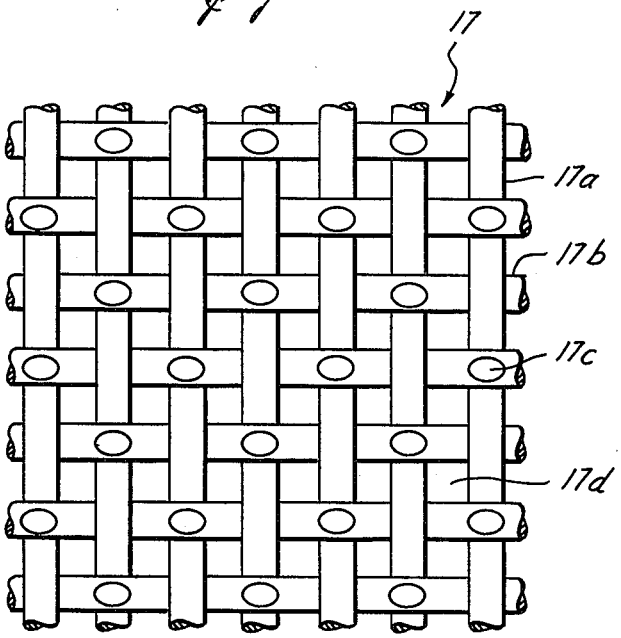
FIG. 6 is a front view of the flattened woven wire of FIG. 5 taken along line 6—6 in FIG. 5.

A flattened woven wire cathode material 17 is shown in FIGS. 5–6. The outer edges of the horizontal running wire strands 17*b* have been rolled to form flat surfaces 17*c*. The sum of these flat areas 17*c* form the theoretically available contact area for this type of cathode surface. The protuberances which membrane 12 "sees" are formed by those parts of the horizontally running strand, which extend out toward it, the tops of which protuberances are those flattened tops 17*c* of strand 17*b* which membrane 12 could contact. The first set of indentations for this flattened woven wire 27 are the lower open spaces between membrane 12, vertical wires 17*a* and adjacent horizontal wire strands 17*b* as in FIGS. 2–4 for unflattened woven wire. The holes 17*d* between adjacent wire strands form the porous openings through flattened woven wire 17 required to make it a foraminous cathode surface. The flattened woven wire 17 of FIGS. 5–6 like the unflattened woven wire 16 of FIGS. 1–4 represents flattened woven wire which does and does not have a high-surface-area coating.

Conventionally used steel punched plate cathode material 18 is illustrated in FIGS. 7–8. It is not a part of this invention, but is shown for comparative purposes. Notice that while punched plate 18 has a large amount of open space area by way of its holes 19 against which membrane 12 cannot form a surface-to-surface contact, it still has a large amount of flat metal surface area 20 against which membrane 12 can contact when compared to the amount of flat surface area available for membrane contact of the other cathode surfaces illustrated in FIGS. 2–6 and FIGS. 9–12. The essence of this invention is the discovery that this flat area is what causes most of the voltage increase when operating the cell with the membrane urged against the cathode. It is theorized that this flat surface somehow causes hydrogen gas to be trapped between these flat surfaces 20 and membrane 12. Whether this theory is correct or not, it has now been discovered that cell 10 can be operated with the membrane against the cathode at a lower voltage and a lower voltage penalty (defined above) if cathodes are used which have less amounts of flat surfaces or other non-flat surface areas against which the membrane can establish large surface-to-surface contact. Greater than about 20% contact is what is meant as large surface-to-surface contact herein.

Figure 9:
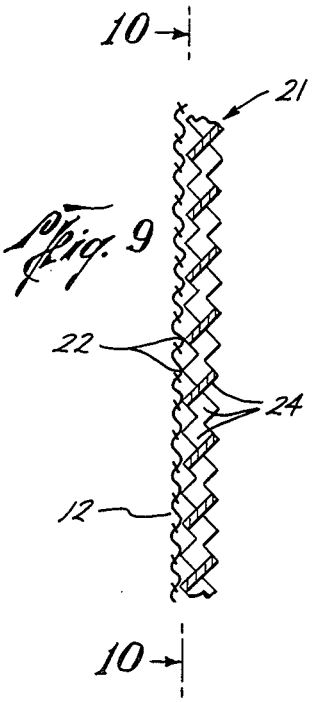
FIG. 9 is an alternative view of FIG. 2 in that cathode 16 is shown made of unflattened expanded metal instead of unflattened woven wire.
Figure 10:
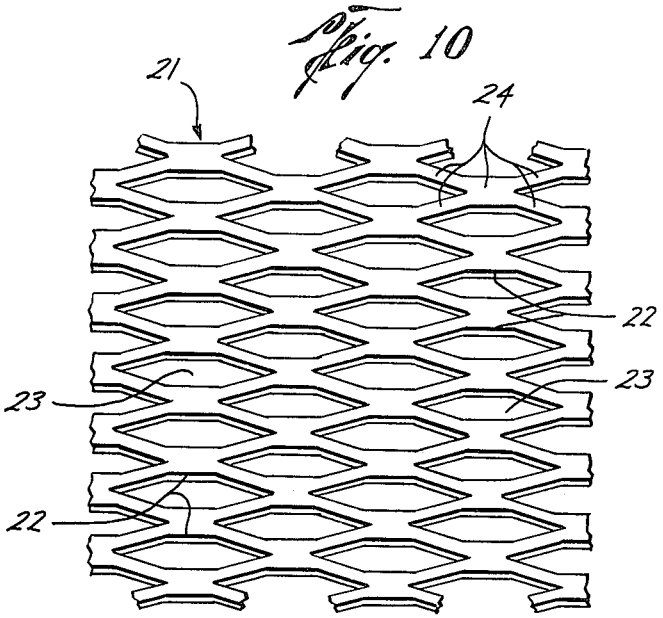
FIG. 10 is a front view of the unflattened expanded metal of FIG. 9 taken along line 10—10 in FIG. 9.

Unflattened diamond shaped expanded metal 21 is illustrated in FIGS. 9–10. Its first set of protuberances are merely the outer top edges 22 of the diamond hole 23 shown contacting membrane 12. There is very little surface area for membrane 12 to contact. The first set of indentations are considered to be those portions of the metal surface 21 which slope away from the membrane 12 and outer top edges 22. Like the unflattened and flattened woven wire 16, 17 of FIGS. 2–6, the unflattened expanded metal 21 of FIGS. 9–10 is taken to represent cathode material which has and has not a high-surface-area low overvoltage cathode coating which is so small as not to be visible on drawings of this size scale. This coating forms a second set of protuberances and indentations on the metal cathode surface facing the membrane.

Figure 11:
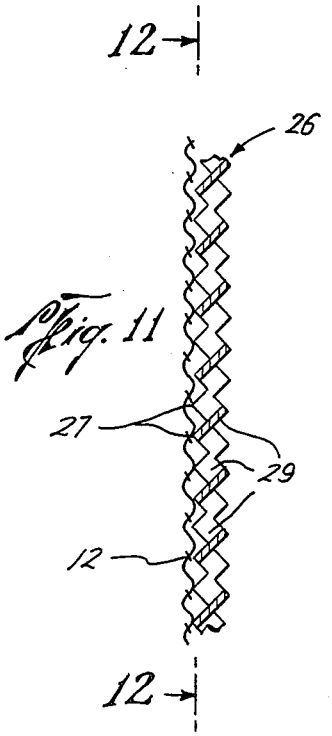
FIG. 11 is an alternative view of FIG. 2 in that cathode 16 is shown made of louvered metal instead of unflattened woven wire.
Figure 12:
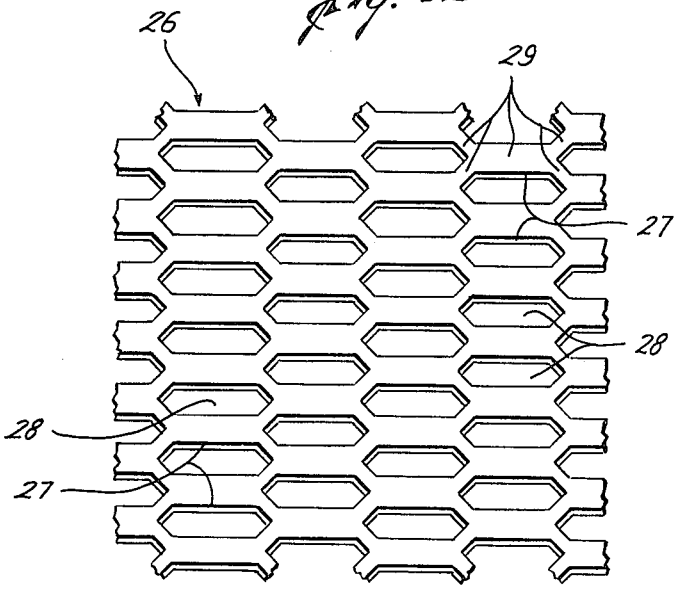
FIG. 12 is a front view of the louvered metal of FIG. 11 taken along line 12—12 of FIG. 11.
Figure 13:
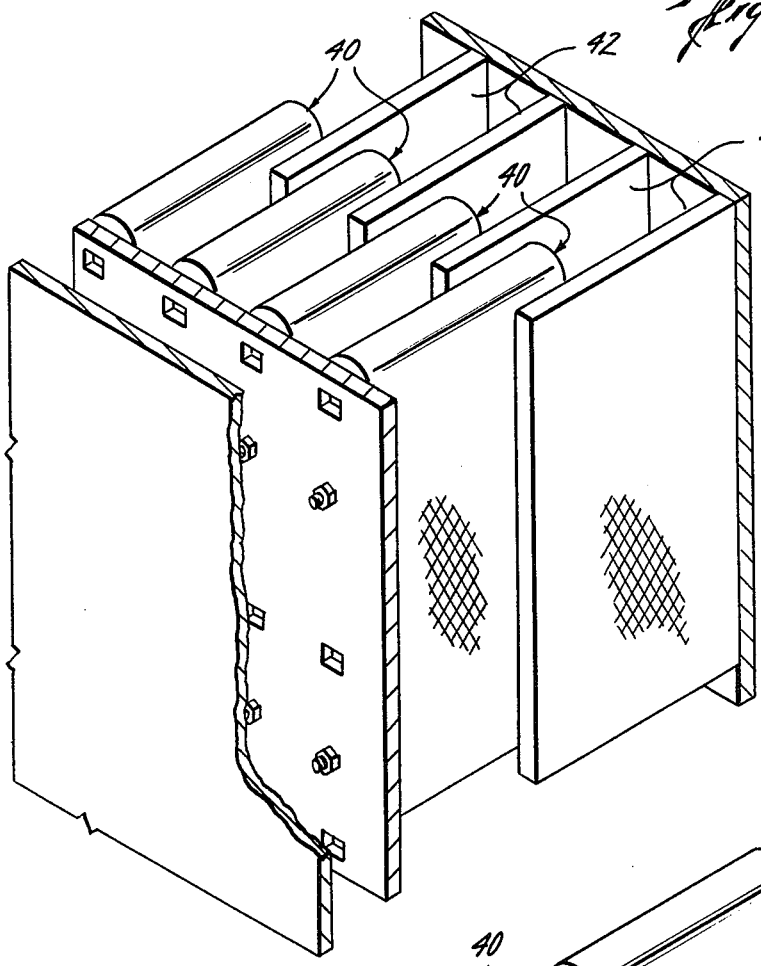
FIG. 13 is an isometric view, partially exploded, of the interior of an alternative electrolysis cell employing a plurality of hollow cathode pockets 40 alternatively interleaved between a plurality of anodes 42 with a membrane envelope 44 enclosing each cathode.
Figure 14:
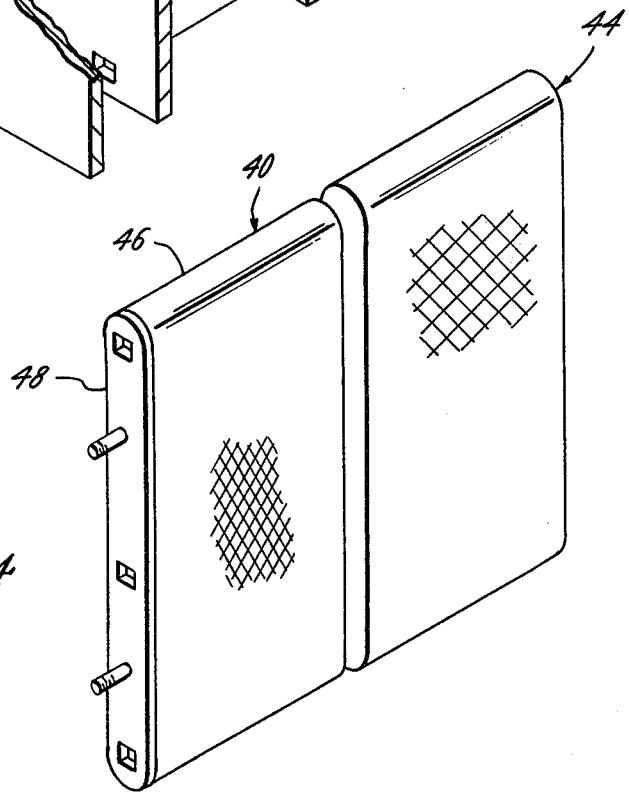
FIG. 14 is an exploded view of a cathode pocket 40 of FIG. 13 showing the membrane envelope 44 separated from the remainder of the cathode pocket 40 which is shown by foraminous metal screen 46 and cathode backbar 48.

Similarly the louvered metal cathode 26 of FIGS. 11–12 is taken to represent metal cathode surfaces which do and do not have high-surface-area (low overvoltage cathode) coatings on it. Also similar to the non-flattened expanded metal 21 of FIGS. 11–12 it has as its first set of protuberances the outer edges 27 of the top edges of the hexagon shaped holes 28 shown contacting membrane 12. A first set of indentations is considered to be all the surfaces 29 receding away from the outmost edges 27 which are the edges which contact membrane 12. Here again it is seen there is very little surface area of louvered metal cathode 16 for membrane 12 to contact.

Holes 28 insure that cathode 26 is foraminous as do holes 23 of cathode 21 of FIGS. 9–10.

The following series of test runs will serve to illustrate the type cathode surfaces, suitable and unsuitable, for use in a cell where the anolyte pressure is greater than the catholyte pressure. Where louvered or unflattened expanded metal were used the arrangement was such that gas evolution was up and away from the membrane. Where it was found that a cathode surface gave exceptionally good results at a current density of 0.5 amperes per square inch (asi), further tests were made on that surface at higher current densities.

TEST RUN 1

A laboratory size cell of the general type of FIG. 1 was fitted with a ruthenium oxide coated titanium mesh anode in the anolyte compartment. The overall anode surface was flat and had a surface area of 28 square inches. In the catholyte compartment a conventional flat surfaced, punched plate steel cathode was fitted parallel to the anode but with a gap in between. This punch plate cathode was like the punch plate cathode 18 shown in FIGS. 7–8. Thirty-six percent of its surface had holes drilled through it leaving 64% of its surface as flat surface with which a membrane could make contact. Thus the theoretically available contact area was 64%. The cell was fitted with a flat Nafion 315 membrane located in the gap between the anode and cathode. Before installation, the membrane was treated in 80° C. water for 30 minutes. The cell had suitable gas exit ports as well as liquid inlet and exit ports. After assembly, the anolyte compartment was filled with 300 grams/liter brine, and the catholyte compartment was filled with 18 weight percent caustic. An electric D.C. current of 14 amps (0.5 asi) was applied to the anode and cathode along with a controlled brine flow to the anolyte compartment. The brine flow was maintained at a rate of 17 milliliters per minute. A flow of water was started and its flowrate was adjusted so that the catholyte effluent from the catholyte compartment equilibrated at 14 weight percent NaOH. The liquid levels of the anolyte and catholyte were first adjusted so that the catholyte pressure was sufficiently greater than the anolyte pressure to clearly move the membrane away from the cathode but just enough to maintain the membrane in slight contact with the anode. Under these circumstances the catholyte level was 13/16 inches higher than the anolyte level. This location of the membrane is taught by the prior art as being the location which will produce the lowest cell operating voltage. The cell was operated under these conditions for a time sufficient (3 days) for the cell voltage to stabilize. This stabilized voltage was found to be 2.96 volts. It is recorded below in Table I under the column heading of "Off Cathode Voltage". Then the anolyte and catholyte levels were readjusted so that the anolyte pressure was then greater than the catholyte pressure and was sufficiently greater so as to clearly maintain the membrane in contact with the cathode. The anolyte level exceeded the catholyte level by 2¼ inches. The prior art teaches that operating the cell with the catholyte pressure greater than the anolyte pressure so that the membrane is in contact with the cathode will cause a drastic increase in cell voltage. It did in this case of the punched plate cathode. The cell voltage immediately jumped from 2.96 volts to 3.61 volts at which it remained for 3 additional days of operation. This voltage is recorded in Table I below under the column heading, "On Cathode Voltage". The caustic efficiency of the cell remained essentially constant at 85–86% in both modes of cell operation. The "Off Cathode" voltage was subtracted from the "On Cathode" voltage to determine the increase in voltage incurred when going from the membrane "Off Cathode" mode of operation to the membrane "On Cathode" mode of operation. This difference in voltage is placed in Table I under the column heading "Voltage Penalty".

It was an object of these test runs to see if there existed certain types of cathode surfaces for which this voltage penalty was only nominal, and if such types did exist to determine what, if anything, they had in common. Certain types of surfaces were found and are part of the substance of this invention. The conventionally used punch plate of Run 1 above and FIGS. 7–8 can be seen not to be of these types.

RUN 2

A cell like that of Run 1 was fitted with a cathode made of a stainless steel sheet of sintered metal with pore sizes of 10 microns. The same procedure used in Run 1 was followed to determine the "Off Cathode" and "On Cathode" voltages. These voltages are recorded in Table I. They can be seen to be lower than the voltages recorded for the punched plate cathode of Run 1. The voltage penalty is seen to be high for some reason.

RUN 3

A cell like that of Run 1 was fitted with a cathode made of a stainless steel sheet of sintered metal having a larger pore size than Run 2, a pore size of 40 microns instead of 10 microns. The same procedure used in Run 1 was again followed in determining the "Off Cathode" and the "On Cathode" voltages. The "Off Cathode" voltage was unexplainably higher than the "Off Cathode" voltage of the 10 micron pore size sintered metal of Run 2 while the "On Cathode" voltage was only slightly smaller. This resulted in a small voltage penalty (0.05 v).

RUN 4

A cell like that of Run 1 was fitted with a flat cathode made of conidure perforated steel which was 22 gauge and 0.0469 inch pore size. It was made by the National Standard Company. The method used in determining the "Off Cathode" and "On Cathode" voltage of Run 1 again was followed. The results are recorded in Table I. The "On Cathode" voltage and "Voltage Penalty" are better than the punched steel plate of Run 1 but are worse than the 40 micron sintered metal of Run 3.

RUN 5

A cell like that of Run 1 was fitted with a cathode made of Chandler expanded steel metal. The dimensions for this expanded metal were: 0.216 inch SWD×0.4 inch LWD×0.078 inch metal thickness×0.080 inch strand width. The "SWD" and "LWD" are the conventional dimensions used in describing expanded and louvered metals. The "LWD" stands for "long way dimension" and is a measure of the longest dimension of each section formed in the metal. The "SWD" stands for "short way dimension" and is a measure of the width of each section.

The same procedure used in Run 1 for determining the "On Cathode" and "Off Cathode" voltages were followed in determining the same voltages here. These voltages are recorded in Table I.

RUN 6

A cell like that of Run 1 was fitted with another steel expanded metal type cathode. This expanded metal is like the unflattened expanded metal shown in FIGS. 9–10. It had the following dimensions: 0.25 inch SW×1.0 inch LWD×0.048 inch strand thickness×0.072 inch strand width.

The same procedure for determining voltages as used in determining the voltages of Run 1 were used here. They are recorded in Table I. Since the "On Cathode" voltage for this type metal had fallen below the "Off Cathode" voltage for the punched plate of Run 1 and since the voltage penalty was only nominal, a second and a third run were made at the doubled and redoubled current density of 1.0 amp/in.$^2$ and 2.0 amp/in.$^2$. The voltages were measured according to the procedure given in Run 1 and are recorded in Table I.

RUN 7

A cell like that of Run 1 as fitted with a cathode made from steel, unflattened woven wire like that shown in FIGS. 2–4. This woven wire is characterized as: $5\frac{1}{2}\times 6$ strands/inch of 13 gauge wire. The same procedure used in Run 1 for determining voltages was followed here, and these voltages are recorded in Table I. Voltages for current densities of 1.0 asi and 2.0 asi are given as well as for 0.5 asi.

RUN 8

A cell like that of Run 1 was fitted with Niles louvered #104 metal cathode which has the surface appearance of the louvered metal shown in FIGS. 11–12. This louvered metal is characterized as: 0.19 inch SWD×0.75 inch LWD×0.048 inch metal thickness×0.72 inch strand width.

Voltages were measured as they were in Run 1. Voltages for 1.0 asi and 2.0 asi current densities were also determined. All voltages are recorded in Table I. Notice that these voltages and voltage penalties are quite low.

RUN 9

A cell like that of Run 1 was fitted with a cathode made of flattened woven wire like that shown in FIGS. 5–6. The flattened woven wire is characterized as: 6×6 strands per inch of 13 gauge wire flattened to 0.092 inch. The flat surface area of the flattened zones (17*c* in FIGS. 5–6) was calculated to be about 20% of the total cathode area against which the membrane could make surface-to-surface contact. Again the membrane "Off Cathode" and membrane "On Cathode" voltages were measured following the procedure used in Run 1. These voltages along with their corresponding voltage penalties are recorded in Table I.

It is quite enlightening to compare the voltages of this run using flattened woven wire with the voltages of Run 7 wherein unflattened woven wire was used. For all three current densities the flattened wire gives undesired higher voltages and voltage penalities than those of the non-flattened woven wire. This is the first evidence that flat surfaces against which the membrane can make large scale surface-to-surface contact with the cathode is the source of the problem of incurring drasticly high voltage penalties when operating a cell with the membrane against the cathode. Identifying the source of this problem is one of the major factors contributing to this invention.

RUN 10

A cell like the cell in Run 1 was fitted with a cathode made from identically the same flattened woven wire as was used in Run 9 with the exception that it had a high-surface-area coating of nickel plasma sprayed on it. That is these flattened wire cathodes were made into the well known low overvoltage cathodes (LOC). Voltages were taken following the procedure set forth in Run 1 for measuring "On Cathode" and "Off Cathode" voltages and calculating "Voltage Penalties". These are recorded in Table I.

Another enlightening comparison can be made by comparing these LOC voltages with those of the non-plasma sprayed flattened woven wire cathode voltages of Run 9. As would be expected with a plasma sprayed flattened woven wire cathode, its cell voltages for both "On Cathode" and "Off Cathode" operation were lower than the non-plasma sprayed flattened woven wire cathode cell voltages of Run 9. Unexpected, however, was the significantly large decrease in the voltage penalty between the plasma-sprayed and non-plasma-sprayed cathode cells. A study of the voltages shows that these nominal voltage penalties were due to the much smaller increases incurred by the cell containing the plasma-sprayed coatings when the membrane was moved from "Off Cathode" operation to "On Cathode" operation. It is true that plasma-spraying nickel on the cathode produced many indentations and protuberances on the cathode on top of the much larger indentations and protuberances formed by the contours of the woven wire strands. Yet these protuberances and indentations are on the other of size magnitude of the protuberances and indentations of the sintered metal cathodes in Runs 2 and 3. Those two runs a large voltage penalty was incurred (Run 2) or a small voltage penalty was achieved only by an unexplained high "Off Cathode" voltage increase (Run 3). Hence, incurring smaller voltage penalties in this run (Run 10) than in Run 9 while still achieving lower "Off Cathode" and "On Cathode" voltages can only be attributed to some phenomena as yet unexplained. There appears to be a synergistic combination working between the two concepts of employing a high surface area (and LOC surface) on a non-flat cathode surface, i.e., on a cathode surface full of large (about 1 mm to about 2 cm) protuberances and indentations.

RUN 11

To verify the conclusions reached in Run 10, in this run a high-surface-area nickel coating was plasma-sprayed onto the same type Niles expanded metal cathode used in Run 6. This cathode was fitted into a cell like the cell of Run 1, Run 6 and voltages were taken following the procedure set out in Run 1. These voltages are recorded in Table I. As in comparing Run 10 with Run 9, again the "Off Cathode" and "On Cathode" were lower for Run 11 than they were for Run 6 and again the voltage penalties of the plasma-sprayed flattened woven wire cathode cell of this run were lower than the non-plasma-sprayed flattened woven wire cathode cell of Run 6. Thus the evidence of a synergistic effect found in Run 10 is bolstered by the same type findings made in this run.

CONCLUSIONS DRAWN FROM RUNS MADE

1. Flat surface on cathode to which membrane can make surface--to-surface contact causes increased cell voltage and increased voltage penalty when operating with membrane on the cathode. 2. Voltage penalties incurred by operating cell with membrane against cathode can be significantly reduced by employing cathodes which have protuberances and indentations on its surface so as to prevent the membrane from making any significant surface-to-surface contact with the cathode, preferably less than about 20% area contact, and more preferably less than about 10% surface-to-surface area contact—the protuberances being on the order of about 1 mm to about 1 or 2 cm. 3. There is a synergistic effect achieved in reducing the voltage penalty when using a foraminous cathode which has the combination of (a) protuberances and indentations in its surface of a size of from about 1 mm to about 1 cm, and (b) a high-surface-area, low-overvoltage coating on top of the cathode surface whose indentations and protuberances are on the order of from about 1 micron to about 200 microns.

TABLE I

| RUN | CATHODE TYPE | CURRENT DENSITY (ASI) | VOLTAGE ON CATHODE | VOLTAGE OFF CATHODE | PENALTY |
|---|---|---|---|---|---|
| 1 | Punch plate steel | 0.5 | 3.61 | 2.96 | 0.65 |
| 2 | 10 micron stainless sheet | 0.5 | 3.09 | 2.75 | 0.34 |
| 3 | 40 micron stainless sheet | 0.5 | 3.00 | 2.95 | 0.05 |
| 4 | Conidure perforated | 0.5 | 3.27 | 3.12 | 0.15 |
| 5 | Chandler expanded metal | 0.5 | 3.01 | 2.90 | 0.11 |
| 6 | Niles standard diamond | 0.5 | 2.84 | 2.81 | 0.03 |
| | expanded metal | 1.0 | 3.25 | 3.20 | 0.05 |
| | | 2.0 | 4.55 | 4.27 | 0.28 |
| 7 | Woven wire | 0.5 | 2.79 | 2.74 | 0.05 |
| | | 1.0 | 3.24 | 3.15 | 0.09 |
| | | 2.0 | 4.15 | 4.05 | 0.10 |
| 8 | Niles louvered #104 | 0.5 | 2.85 | 2.83 | 0.02 |
| | | 1.0 | 3.48 | 3.33 | 0.15 |
| | | 2.0 | 4.47 | 4.44 | 0.03 |
| 9 | Flattened woven wire | 0.5 | 2.90 | 2.80 | 0.10 |
| | | 1.0 | 3.60 | 3.30 | 0.30 |
| | | 2.0 | 4.70 | 4.30 | 0.40 |
| 10 | Nickel coated flattened | 0.5 | 2.70 | 2.69 | 0.01 |
| | Woven wire | 1.0 | 3.18 | 3.12 | 0.06 |
| | | 2.0 | 3.99 | 3.88 | 0.11 |
| 11 | Nickel coated Niles | 0.5 | 2.58 | 2.56 | 0.02 |
| | standard diamond | 2.0 | 4.25 | 4.16 | 0.09 |
| | expanded metal | | | | |

What is claimed is:

1. In an electrolysis cell containing a non-rigid permionic polymeric plastic film membrane disposed between a foraminous metal cathode and an anode so as to form a catholyte compartment and an anolyte compartment, said catholyte compartment containing said cathode and a volume of catholyte, said anolyte compartment containing said anode and a volume of anolyte, the adjacent surfaces of said anode and said cathode being spaced apart sufficiently for said membrane to fit freely therebetween, the improvement which comprises:

a. the surface of said cathode facing the membrane, in addition to being foraminous, having protuberances and indentations thereon and therein so as to present a non-flat surface to the adjacent membrane and b. means for maintaining the anolyte at a greater pressure than the catholyte.

2. The cell of claim 1 wherein the area of the cathode surface facing the membrane which is available surface-to-surface contact area between this surface and the membrane is no more than about 20% of this cathode surface.

3. The cell of claim 1 wherein the area of the cathode surface facing the membrane which is available surface-to-surface contact area between this cathode surface and the membrane is no more than about 10% of this cathode surface.

4. The cell of claims 1, 2 or 3 wherein the cathode is made at least predominately of ferrous metal in the form of unflattened woven wire.

5. The cell of claims 1, 2, or 3 wherein the cathode is made at least predominately of ferrous metal and made in the form of non-flattened expanded metal.

6. The cell of claims 1, 2, or 3 wherein the cathode is made at least predominately of ferrous metal and made in the form of louvered mesh.

7. The cell of claims 1, 2, or 3 wherein the cathode is made at least predominately of ferrous metal, made in the form of non-flattened woven wire, and having a high-surface-area coating of nickel.

8. The cell of claims 1, 2, or 3 wherein the cathode is made at least predominately of ferrous metal, made in the form of non-flattened expanded metal, and having a high-surface-area coating of nickel.

9. The cell of claims 1, 2, or 3 wherein the cathode is made at least predominately of ferrous metal, made in the form of non-flattened louvered metal, and having a high-surface-area coating of nickel.

10. In a brine electrolysis cell containing a catholyte compartment and an anolyte compartment, said catholyte compartment containing catholyte and spaced vertical forminous cathode pockets, said anolyte compartment containing anolyte and spaced vertical anodes, said cathode pockets being spaced from and interleaved between said anodes, said cell having non-rigid polymeric plastic permionic type membranes disposed between facing surfaces of adjacent anodes and cathode pockets thereby serving as boundaries between the anolyte and catholyte compartments, the improvement which comprises the combination of:

a. at least some of the foraminous cathode pockets having cathode surfaces facing the adjacent membranes which have sufficient protuberances and indentations so as to present the adjacent membrane with such an uneven surface that there is no more than a small available area of surface contact between the membrane and cathode pocket; and b. means for maintaining a greater pressure in the anolyte than in the catholyte.

11. The improved cell of claim 10 wherein the available area of surface contact of at least one of the cathodes is no more than about 20% of the cathode surface facing the membrane.

12. The improved cell of claim 10 wherein the available area of surface contact of at least one of the cathodes is no more than about 10% of the cathode surface facing the membrane.

13. The cell of claims 10, 11 or 12 wherein the available area of surface contact of the working surfaces of at least one of the cathodes are made of unflattened woven wire.

14. The cell of claims 10, 11 or 12 wherein the working surfaces of the cathode are made of unflattened expanded metal.

15. The cell of claims 10, 11 or 12 wherein the working surfaces of at least some of the cathodes are made at least predominately of a ferrous metal in the form of unflattened woven wire with said ferrous metal having a high-surface-area coating of nickel.

16. The cell of claims 10, 11 or 12 wherein the working surfaces of at least some of the cathodes are made at least predominately of a ferrous metal in the form of unflattened expanded metal with said ferrous metal having a high-surface-area coating of nickel.

17. In the method of operating an electrolysis cell in which there is a catholyte compartment containing a vertical foraminous cathode and a volume of catholyte, in which there is an anolyte compartment containing a vertical anode and a volume of anolyte, in which there is a non-rigid, polymeric plastic, substantially hydraullically impermeable ion exchange membrane film separating the anolyte and catholyte compartments and being disposed between the anode and cathode which themselves are spaced from one another, the improvement which comprises:

maintaining a higher pressure in the anolyte chamber than in the catholyte chamber so that the membrane is pushed toward the cathode, the surface of said cathode which faces the membrane in addition to being foraminous having protuberances and indentations on and in it so as to present a non-flat surface to the membrane.

* * * * *

UNITED STATES PATENT AND TRADEMARK OFFICE

CERTIFICATE OF CORRECTION

PATENT NO. : 4,265,719

DATED : May 5, 1981

INVENTOR(S) : Bobby R. Ezzell, et al

It is certified that error appears in the above-identified patent and that said Letters Patent are hereby corrected as shown below:

Col. 6, line 23, "prefectly" should be ---perfectly---.

Col. 9, line 30, "virturally" should be ---virtually---.

Col. 12, line 53, "SW x 1.0" should be ---SWD x 1.0---.

Col. 12, line 62, "amp" second occurrence should be--amps--.

Col. 13, line 38, "penalities" should be ---penalties---.

Col. 16, line 36, "forminous" should be ---foraminous---.

Signed and Sealed this

*Third* Day of *November 1981*

[SEAL]

*Attest:*

GERALD J. MOSSINGHOFF

*Attesting Officer*

*Commissioner of Patents and Trademarks*